US011866285B2

(12) United States Patent
Tamura et al.

(10) Patent No.: US 11,866,285 B2
(45) Date of Patent: Jan. 9, 2024

(54) COATING FILM TRANSFER TOOL

(71) Applicant: Tombow Pencil Co., Ltd., Tokyo (JP)

(72) Inventors: Yutaka Tamura, Tokyo (JP); Hiromichi Fujisawa, Tokyo (JP); Takuya Yashiro, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 16/628,238

(22) PCT Filed: Jul. 4, 2017

(86) PCT No.: PCT/JP2017/024551
§ 371 (c)(1),
(2) Date: Jan. 2, 2020

(87) PCT Pub. No.: WO2019/008687
PCT Pub. Date: Jan. 10, 2019

(65) Prior Publication Data
US 2020/0122953 A1 Apr. 23, 2020

(51) Int. Cl.
*B65H 37/00* (2006.01)

(52) U.S. Cl.
CPC ..... *B65H 37/007* (2013.01)

(58) Field of Classification Search
CPC ..... B65H 37/007; B65H 2402/41
See application file for complete search history.

(56) References Cited

U.S. PATENT DOCUMENTS 4,959,046 A 9/1990 Brunetto et al.
5,234,734 A 8/1993 Hamada
5,597,633 A 1/1997 Mecke et al.
5,714,035 A * 2/1998 Stevens ..... B41J 29/367 156/577
5,759,341 A 6/1998 Kobayashi
5,785,437 A 7/1998 Koyama et al.
5,792,263 A 8/1998 Koyama et al.
(Continued)

FOREIGN PATENT DOCUMENTS

EP 0427870 A1 5/1991
EP 1273544 A1 1/2003
(Continued)

OTHER PUBLICATIONS

Sep. 12, 2017, International Search Report from the Japan Patent Office in PCT/JP2017/024551, which is the international application to this U.S. application.
(Continued)

*Primary Examiner* — Alex B Efta
(74) *Attorney, Agent, or Firm* — Kolitch Romano Dascenzo Gates LLC

(57) ABSTRACT

Provided is a coating film transfer tool having a pivotable transfer head and a tape guide for transfer tape, and capable of satisfactorily transferring a coating film. In some examples, such a coating film transfer tool includes tape guides respectively having lower sides disposed on a first side of a main body where the transfer tape passes before coating film transfer, and upper sides disposed on a second side of the main body where the transfer tape passes after coating film transfer passes. An interval between the upper sides is wider than an interval at a position where an interval between the lower sides is narrowest.

4 Claims, 8 Drawing Sheets

(56) References Cited

U.S. PATENT DOCUMENTS

| | | | | |
|---|---|---|---|---|
| 5,820,728 | A | 10/1998 | Stevens | |
| 5,991,568 | A | 11/1999 | Ziegelmuller et al. | |
| 6,273,169 | B1 | 8/2001 | Ono | |
| 6,444,266 | B1 | 9/2002 | Mizuno | |
| 6,510,884 | B1 | 1/2003 | Chan | |
| 6,776,209 | B1 | 8/2004 | You | |
| 7,070,051 | B2 | 7/2006 | Kanner et al. | |
| 7,228,882 | B2 | 6/2007 | Marschand et al. | |
| 9,821,347 | B2 | 11/2017 | Nakane | |
| 9,969,590 | B2 | 5/2018 | Fujisawa | |
| 2002/0088554 | A1 | 7/2002 | Bouveresse et al. | |
| 2003/0062135 | A1 | 4/2003 | Takahashi | |
| 2003/0121613 | A1* | 7/2003 | Tamai | B65H 37/007 156/577 |
| 2005/0056376 | A1* | 3/2005 | Marschand | B65H 37/007 156/540 |
| 2005/0150606 | A1* | 7/2005 | Marschand | B65H 37/007 156/577 |
| 2006/0251888 | A1 | 11/2006 | Lane et al. | |
| 2006/0251889 | A1 | 11/2006 | Lane et al. | |
| 2006/0251890 | A1 | 11/2006 | Lane et al. | |
| 2006/0263596 | A1 | 11/2006 | Bamborough et al. | |
| 2007/0113987 | A1 | 5/2007 | Ushijima | |
| 2007/0218276 | A1 | 9/2007 | Hiramatsu et al. | |
| 2007/0231571 | A1 | 10/2007 | Lane et al. | |
| 2008/0173406 | A1* | 7/2008 | Wu | B65H 37/007 156/540 |
| 2009/0026302 | A1 | 1/2009 | Kinugasa et al. | |
| 2009/0050275 | A1 | 2/2009 | Sakanishi | |
| 2009/0185849 | A1* | 7/2009 | Narita | B65H 37/007 401/88 |
| 2009/0205785 | A1 | 8/2009 | Rolion | |
| 2010/0084095 | A1 | 4/2010 | Sekiya et al. | |
| 2010/0139707 | A1 | 6/2010 | Boonstra et al. | |
| 2011/0000622 | A1* | 1/2011 | Rolion | B65H 37/007 156/538 |
| 2011/0244136 | A1 | 10/2011 | Ryabova | |
| 2012/0267047 | A1 | 10/2012 | Maus et al. | |
| 2014/0023858 | A1 | 1/2014 | Igarashi et al. | |
| 2014/0318700 | A1 | 10/2014 | Henderson et al. | |
| 2017/0247792 | A1 | 8/2017 | Kobashi | |
| 2018/0015775 | A1 | 1/2018 | Tamura | |

FOREIGN PATENT DOCUMENTS

| | | | |
|---|---|---|---|
| JP | 02088057 | A | 3/1990 |
| JP | 09071097 | A | 3/1997 |
| JP | 09104562 | A | 4/1997 |
| JP | 09124219 | A | 5/1997 |
| JP | 10052995 | A | 2/1998 |
| JP | 10181289 | A | 7/1998 |
| JP | 10217688 | A | 8/1998 |
| JP | 11001095 | A | 1/1999 |
| JP | 2876301 | B2 | 3/1999 |
| JP | 2001240812 | A | 9/2001 |
| JP | 2002264587 | A | 9/2002 |
| JP | 2002274097 | A | 9/2002 |
| JP | 2004110589 | A | 4/2004 |
| JP | 2004299602 | A | 10/2004 |
| JP | 2005047201 | A | 2/2005 |
| JP | 2006-123544 | A | 5/2006 |
| JP | 2006-281495 | A | 10/2006 |
| JP | 3870986 | B2 | 1/2007 |
| JP | 2007154022 | A | 6/2007 |
| JP | 2007295776 | A | 11/2007 |
| JP | 2007307874 | A | 11/2007 |
| JP | 2008096389 | A | 4/2008 |
| JP | 2008-162052 | A | 7/2008 |
| JP | 4144798 | B2 | 9/2008 |
| JP | 2009-083403 | A | 4/2009 |
| JP | 2009252416 | A | 10/2009 |
| JP | 2010002733 | A | 1/2010 |
| JP | 2010037936 | A | 2/2010 |
| JP | 2011121204 | A | 6/2011 |
| JP | 2011245696 | A | 12/2011 |
| JP | 2012195747 | A | 10/2012 |
| JP | 5178525 | B2 | 4/2013 |
| JP | 2014011139 | A | 1/2014 |
| JP | 2016124131 | A | 7/2016 |
| JP | 6073025 | B1 | 2/2017 |
| JP | 6247199 | B2 | 12/2017 |
| WO | 9615060 | A1 | 5/1996 |

OTHER PUBLICATIONS

Aug. 6, 2020, Office Action of the US Patent and Trademark Office, U.S. Appl. No. 16/026,322.

* cited by examiner (a)

(b)

COATING FILM TRANSFER TOOL

TECHNICAL FIELD

The present disclosure relates to a coating film transfer tool transferring a transfer tape for correction, adhesion, or the like.

BACKGROUND

In a general coating film transfer tool, a supply reel around which a transfer tape holding a coating film on one surface is wound, and a winding reel around which the transfer tape is wound after the coating film is transferred, are disposed in a housing. The transfer tape is drawn from the supply reel and the coating film is transferred onto a transfer target surface in a transfer head protruding from the housing. Then, the transfer tape is wound around the winding reel.

The pressing portion that is provided at the front end of the transfer head needs to be pressed against the transfer target surface with a uniform force for the coating film to be satisfactorily transferred onto the transfer target surface.

The right-left-direction pressing force in the pressing portion becomes non-uniform when the housing is inclined to the right and left during actual transfer. Then, a partial defect may arise at the right and left ends of the transferred coating film. In addition, the non-uniform pressing force results in a part where the adhesion of the coating film to the transfer target surface is insufficient, and then problems arise with the transferred coating film cracking or the coating film scraped during writing.

A coating film transfer tool has been proposed in this regard, in which an elastic member constitutes a shaft connecting the transfer head and the housing or the like. The pressing portion is pivoted by the elastic force of the shaft when the transfer head is pressed against a transfer object, and the pressing portion is capable of returning when the pressing is finished (see PTL 1). With this tool, the pressing force is made uniform by the pressing portion being brought into close contact with the transfer target surface.

However, in the coating film transfer tool proposed in PTL 1, the transfer head needs to be pressed against the transfer object with a strong force for the force of pressing by the pressing portion to be uniform.

PTL 2 discloses a coating film transfer tool configured such that a transfer head can be pivoted with a lighter force by the pivot shaft of the transfer head being pivotably connected to a housing or the like without elastic deformation (see, for example, PTL 2).

In a case where the transfer head can be pivoted with a light force as described above, the transfer head can be pivoted and become parallel to a transfer target surface simply by the transfer head being pressed with a slight force against the transfer target surface.

As a result, the pressing force with which the pressing portion presses the transfer target surface can be made uniform with a light force and coating film transfer can be performed without any defect or hollow.

CITATION LIST

Patent Literature

PTL 1: JP-A-2006-281495
PTL 2: JP-A-2009-083403

SUMMARY

Technical Problem

However, when the transfer head can be pivoted with a light force, the transfer tape is likely to meander, the transfer tape may come into contact with a tape guide provided on the transfer head, and the coating film may be scraped or peeled off.

When the transfer tape comes into contact with the tape guide in the vicinity of the pressing portion in particular, a twisted transfer tape may be transferred and the coating film may become partially defective.

Meanwhile, conceivable options to prevent contact between the transfer tape and the tape guide are: providing no tape guide and increasing the width of the tape guide as a whole.

Then, however, the transfer tape may be removed from the pressing portion. In addition, even when the transfer tape is not removed from the pressing portion, the deviation width of the transfer tape from the center of the pressing portion increases and the transfer tape cannot be easily used.

An object of the present disclosure is to provide a coating film transfer tool capable of satisfactorily transferring a coating film in a configuration in which a transfer head is pivotable and a tape guide is provided.

Solution to Problem

The present disclosure provides the following so as to solve the above problems.

(1) A coating film transfer tool includes a housing having disposed therein a supply reel around which a transfer tape before coating film transfer is wound and a winding reel around which a transfer tape after coating film transfer is wound and a transfer head pivotable with respect to the housing or an accommodating member accommodated in the housing. The transfer head is provided with a main body portion held by the housing or the accommodating member and protruding from the housing or the accommodating member, a pressing portion provided at a front end of the main body portion, and a pair of tape guides disposed on right and left sides of the main body portion orthogonal to a front-rear direction. The pair of tape guides respectively have lower side tape guides disposed on a side of the main body portion where the transfer tape passes before the coating film transfer and upper side tape guides disposed on a side of the main body portion where the transfer tape passes after the coating film transfer. An interval between the pair of upper side tape guides is wider than an interval at a position where an interval between the pair of lower side tape guides is narrowest.

(2) Preferably, a front end of the upper side tape guide is disposed closer to the pressing portion than a front end of the lower side tape guide.

(3) Preferably, the transfer head further includes a shaft portion held by the housing or the accommodating member and serving as a center of pivoting of the transfer head and the main body portion is provided on a front side as one side of the shaft portion in a longitudinal direction.

(4) A coating film transfer tool includes a housing having disposed therein a supply reel around which a transfer tape before coating film transfer is wound and a winding reel around which a transfer tape after coating film transfer is wound and a transfer head pivotable with respect to the housing or an accommodating member accommodated in the housing. The transfer head is provided with a shaft portion held by the housing or the accommodating member and serving as a center of the pivoting, a main body portion provided on a front side as one side of the shaft portion in a longitudinal direction and protruding from the housing or the accommodating member, a pressing portion provided at a front end of the main body portion, and a pair of tape guides disposed on right and left sides of the main body portion orthogonal to the longitudinal direction. The pair of tape guides respectively have lower side tape guides disposed on a side of the main body portion where the transfer tape before the coating film transfer passes and upper side tape guides disposed on a side of the main body portion where the transfer tape after the coating film transfer passes. A front end of the lower side tape guide is at a position retracted from the pressing portion. A front end of the upper side tape guide is disposed behind the front end of the lower side tape guide.

Advantages

According to the present disclosure, it is possible to provide a coating film transfer tool capable of satisfactorily transferring a coating film in a configuration in which a transfer head is pivotable and a tape guide is provided.

DETAILED DESCRIPTION

First Embodiment

Figure 1:
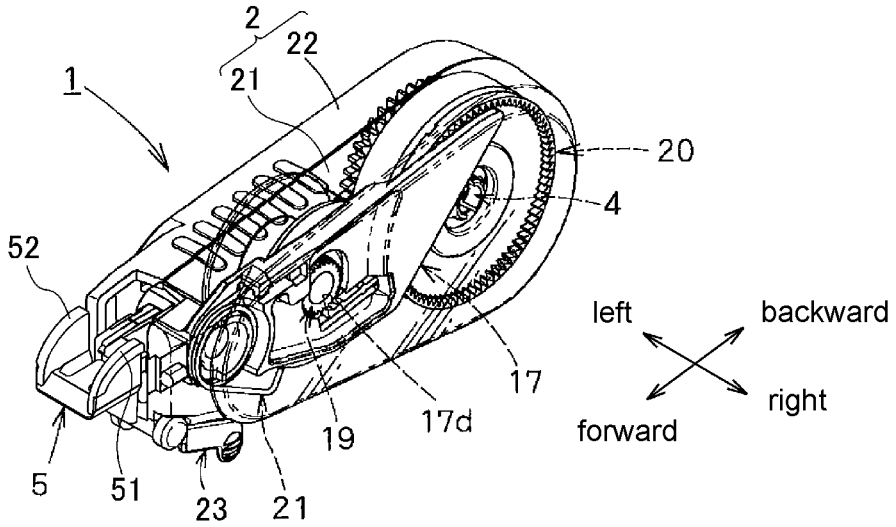
FIG. 1 is a perspective view illustrating a first embodiment of a coating film transfer tool of the present disclosure, in which (a) is an upper perspective view and (b) is a lower perspective view.
Figure 1:
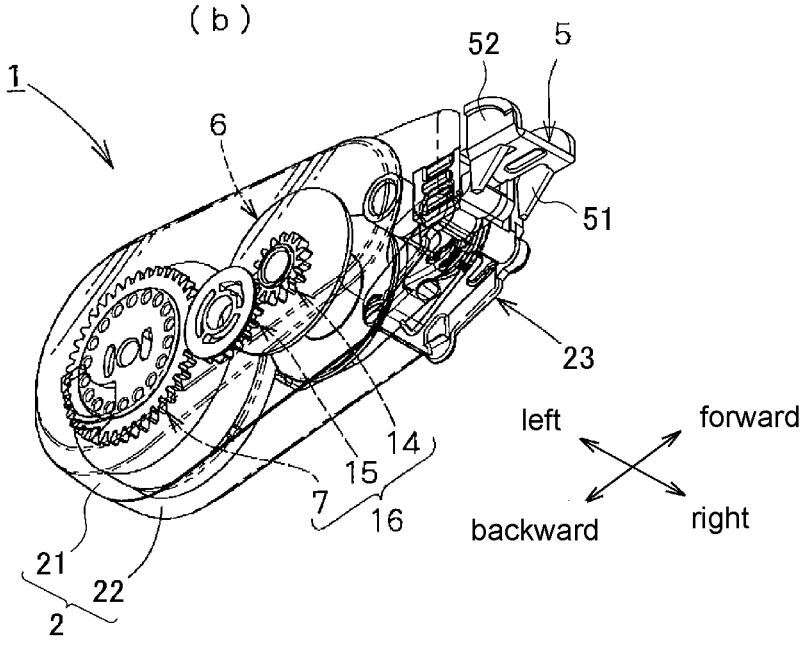
Figure 2:
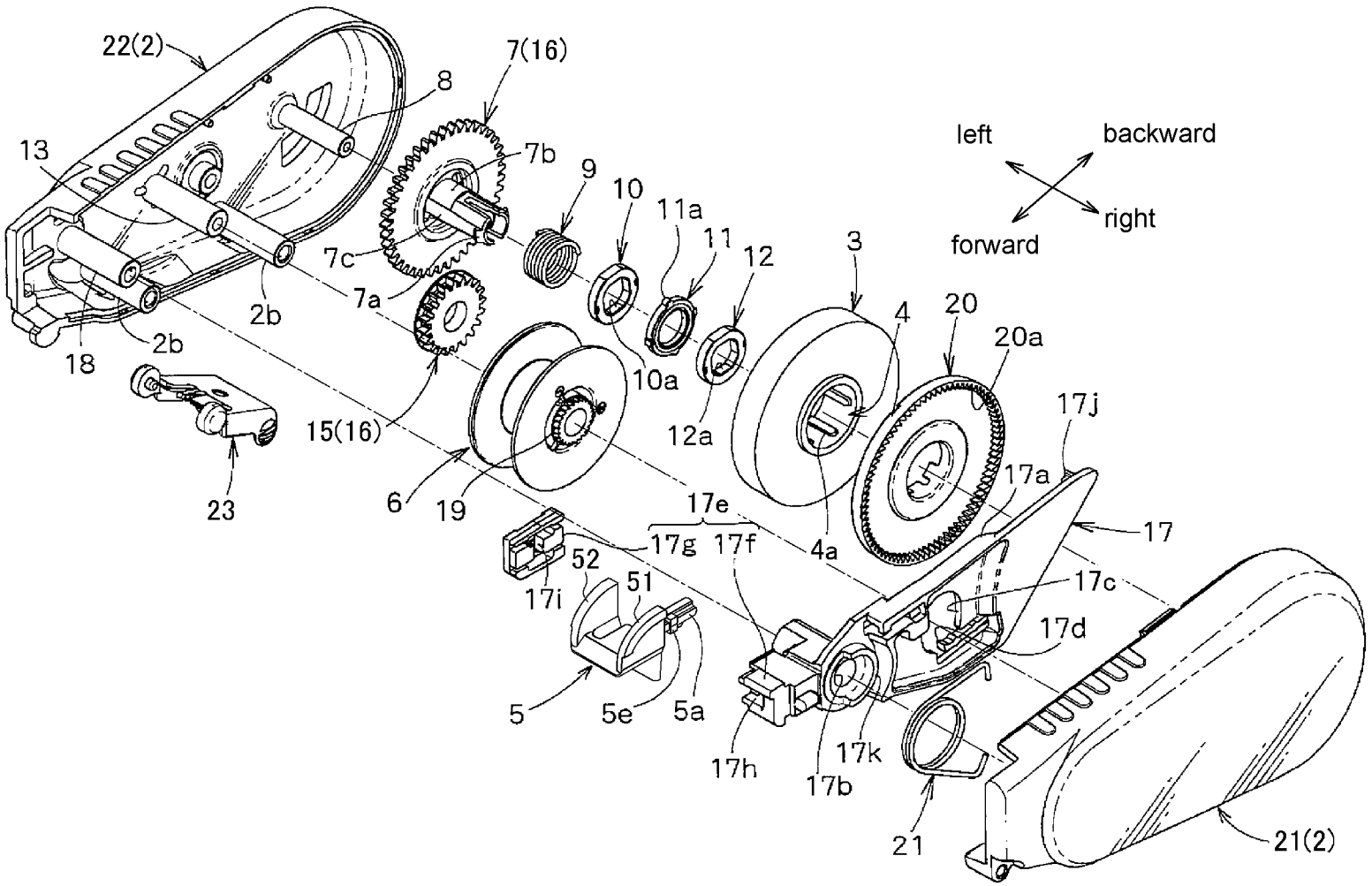
FIG. 2 is an upper perspective exploded view of the coating film transfer tool illustrated in FIG. 1.
Figure 3:
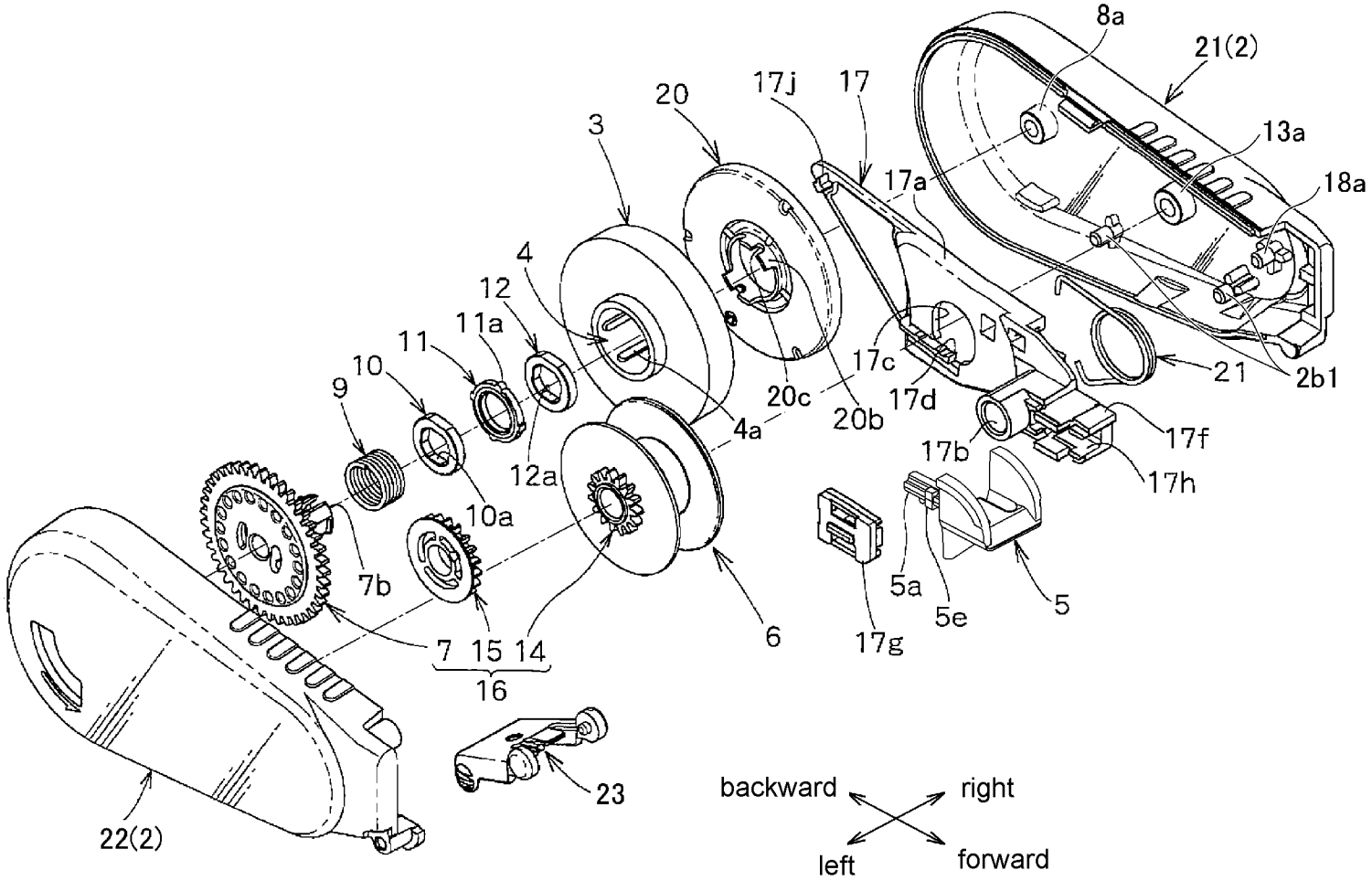
FIG. 3 is a lower perspective exploded view of the coating film transfer tool illustrated in FIG. 1.

Hereinafter, embodiments of the present disclosure will be described. FIG. 1 is a perspective view illustrating a first embodiment of a coating film transfer tool 1 of the present disclosure, in which (a) is an upper perspective view and (b) is a lower perspective view. FIG. 2 is an upper perspective exploded view of the coating film transfer tool 1 illustrated in FIG. 1. FIG. 3 is a lower perspective exploded view of the coating film transfer tool 1 illustrated in FIG. 1.

Incidentally, in the present specification, the direction in which the transfer in the longitudinal direction of the coating film transfer tool 1 is performed will be described as the front and the reverse direction will be described as the rear.

In addition, the direction orthogonal to the longitudinal direction and the side where a transfer tape 3 before coating film transfer passes in a transfer head 5 (described later) will be described as the lower side and the side where the transfer tape 3 after coating film transfer passes will be described as the upper side.

In addition, the direction that is orthogonal to the front-rear direction and the up-down direction and is the right-left direction when the coating film transfer tool 1 is viewed from the front (front surface) will be described as the right-left direction.

The coating film transfer tool 1 is provided with a housing 2. A pair of housing members constitute the housing 2. The housing members are a right housing member 21 and a left housing member 22. Disposed in the housing 2 (between the right housing member 21 and the left housing member 22) are a supply reel 4 around which the transfer tape 3 is wound, a part of the transfer head 5 transferring the transfer tape 3 drawn from the supply reel 4 onto a transfer target surface, a winding reel 6 winding the transfer tape 3 after transfer, and a power transmission mechanism 16 (illustrated in FIG. 3) interlocking the supply reel 4 and the winding reel 6.

As illustrated in FIG. 2, on the inner surface of the left housing member 22, two coupling tubes 2*b*, a supply reel spindle 8, a winding reel spindle 13, and a base member spindle 18 are erected so as to extend toward the right housing member 21.

Meanwhile, as illustrated in FIG. 3, two coupling tube receiving portions 2*b*1 where the coupling tube 2*b* is extrapolated, a supply reel spindle receiving portion 8*a* where the supply reel spindle 8 is interpolated, a winding reel spindle receiving portion 13*a* where the winding reel spindle 13 is interpolated, and a base member spindle receiving portion 18*a* where the base member spindle 18 is extrapolated are provided on the inner surface of the right housing member 21.

The two coupling tubes 2*b* provided on the inner surface of the left housing member 22 are extrapolated in the two coupling tube receiving portions 2*b*1 provided on the inner surface of the right housing member 21. As a result, the pair of right and left housing members, that is, the right housing member 21 and the left housing member 22 are coupled and the housing 2 is formed.

The supply reel spindle 8 provided on the inner surface of the left housing member 22 is interpolated in the supply reel spindle receiving portion 8*a* in a state where a supply reel gear 7, the supply reel 4, and a flange 20 are rotatably extrapolated.

The supply reel gear 7 is provided with a tubular rotary shaft 7*b*, which has an end portion provided with a locking portion 7*a*. A compression spring 9, an annular first spacer 10, an annular elastic body stopper 11, and an annular second spacer 12 are sequentially inserted in the rotary shaft 7*b* and retained by the locking portion 7*a*.

In addition, a locking projection 11*a* is provided on the outer peripheral surface of the elastic body stopper 11. Meanwhile, a rib-shaped locked portion 4*a* locked by the locking projection 11*a* is provided on the inner peripheral surface of the supply reel 4. Then, the elastic body stopper 11 and the supply reel 4 integrally rotate by the locking projection 11*a* being locked to the rib-shaped locked portion 4*a*.

Four flat surface portions 7*c* are formed by the outer peripheral surface of the upper half portion of the rotary shaft 7*b* of the supply reel gear 7 being cut at substantially equal intervals. Meanwhile, in plan view, inner holes 10*a* and 12*a* of the first spacer 10 and the second spacer 12 have corners having an arcuate quadrilateral shape.

The first spacer 10 and the second spacer 12 are non-rotatably fitted to the rotary shaft 7*b* of the supply reel gear 7 by the flat surface portion 7*c* of the rotary shaft 7*b* and the quadrilateral sides of the inner holes 10*a* and 12*a* of the first spacer 10 and the second spacer 12 coming into contact with each other. As a result, the supply reel gear 7, the compression spring 9, the first spacer 10, and the second spacer 12 integrally rotate.

The winding reel 6 is extrapolated on the winding reel spindle 13 erected on the inner surface of the left housing member 22. As illustrated in FIG. 3, a winding reel gear 14 is provided on the left side surface of the winding reel 6. A small gear 15 is provided between the supply reel gear 7 and the winding reel gear 14. The small gear 15 meshes with the supply reel gear 7 and the winding reel gear 14.

The transfer tape 3 wound around the supply reel 4 is unwound as a result of coating film transfer, and then the rotational force of the supply reel 4 is transmitted to the supply reel gear 7 by the frictional force that is generated between side surfaces of the second spacer 12 and the elastic body stopper 11, side surfaces of the elastic body stopper 11 and the first spacer 10, and side surfaces of the supply reel 4 and the supply reel gear 7.

When the supply reel gear 7 rotates, the rotational force is transmitted to the winding reel 6 via the power transmission mechanism 16 including the supply reel gear 7, the small gear 15, and the winding reel gear 14.

Figure 4:
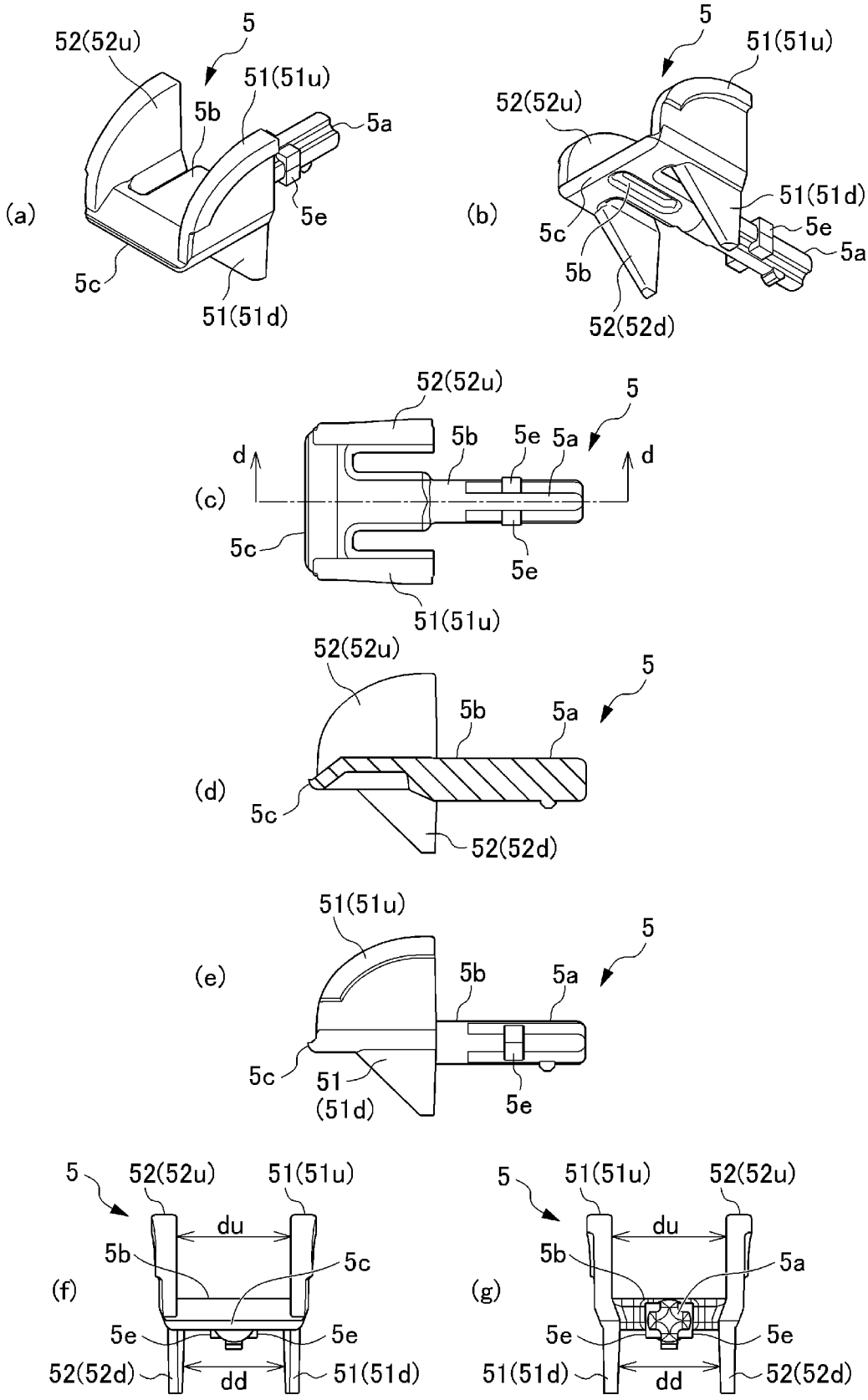
FIG. 4 is an enlarged view of a transfer head of the first embodiment, in which (a) is an upper perspective view, (b) is a lower perspective view, (c) is a plan view, (d) is a longitudinal cross-sectional view taken along the d-d line arrow in (c), (e) is a right side view, (f) is a front view, and (g) is a rear view.

FIG. 4 is an enlarged view of the transfer head 5 of the first embodiment, in which (a) is an upper perspective view, (b) is a lower perspective view, (c) is a plan view, (d) is a longitudinal cross-sectional view taken along the d-d line arrow in (c), (e) is a right side view, (f) is a front view, and (g) is a rear view.

Figure 5:
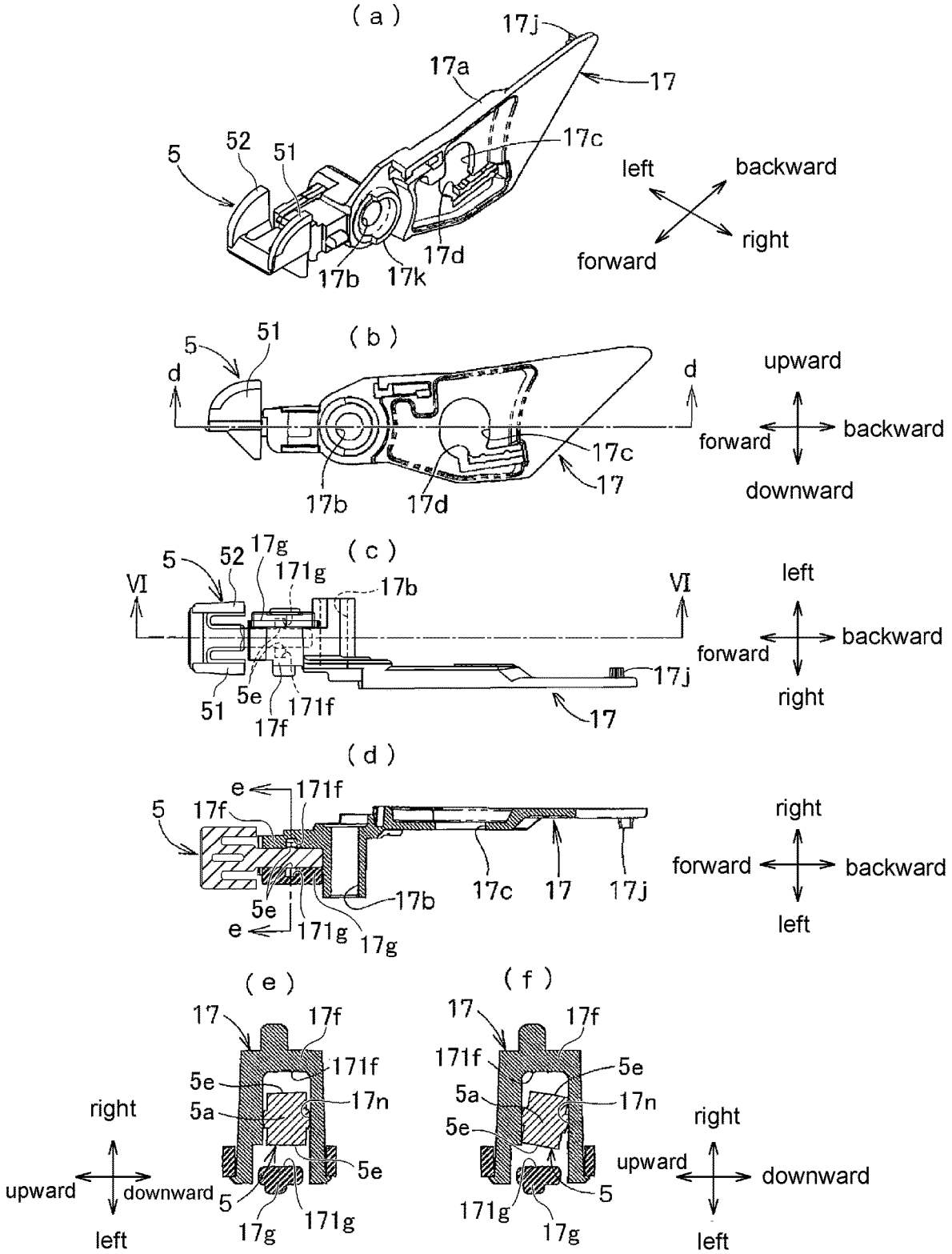
FIG. 5 is a drawing illustrating a state where the transfer head is attached to a base member as an accommodating member accommodated in a housing, in which (a) is an upper perspective view, (b) is a right side view, (c) is a plan view, (d) is a lateral cross-sectional view taken along the d-d line arrow in (b), (e) is a drawing in which a longitudinal end view taken along the e-e line arrow in (d) is illustrated in a direction in which the base member is perpendicular, and (f) is a longitudinal end view corresponding to (e) and illustrating a state where the transfer head has pivoted.

FIG. 5 is a drawing illustrating a state where the transfer head 5 is attached to a base member 17 as an accommodating member accommodated in the housing 2, in which (a) is an upper perspective view, (b) is a right side view, (c) is a plan view, (d) is a lateral cross-sectional view taken along the d-d line arrow in (b), (e) is a drawing in which a longitudinal end view taken along the e-e line arrow in (d) is illustrated in a direction in which the base member 17 is perpendicular, and (f) is a longitudinal end view corresponding to (e) and illustrating a state where the transfer head 5 has pivoted.

Figure 6:
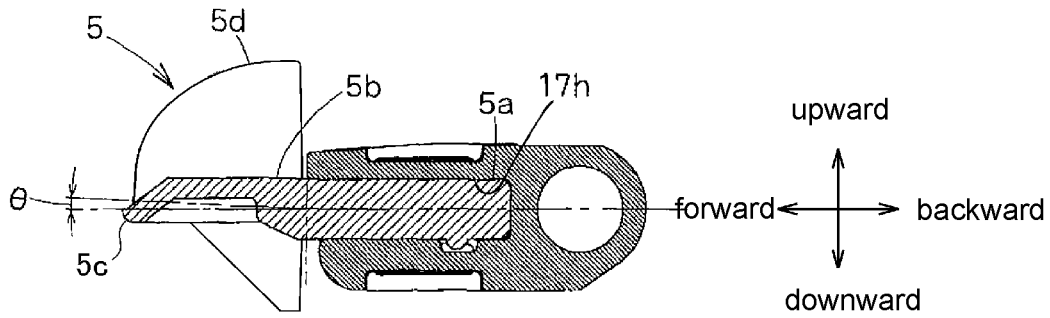
FIG. 6 is an enlarged view illustrating the degree of an inelastic body at a time when a main body portion and a pressing portion in the transfer head are formed as the inelastic body (described later) and is an enlarged longitudinal cross-sectional view taken along the VI-VI line arrow in FIG. 5(*c*).

FIG. 6 is an enlarged view illustrating the degree of an inelastic body at a time when a main body portion 5*b* and a pressing portion 5*c* in the transfer head 5 are formed as the inelastic body (described later) and is an enlarged longitudinal cross-sectional view taken along VI-VI line arrow in FIG. 5(*c*).

The transfer head 5 is provided with the main body portion 5*b*, a shaft portion 5*a* extending rearward from the main body portion 5*b*, and a right tape guide 51 and a left tape guide 52 spaced apart from each other on the right and left of the main body portion 5*b*.

As illustrated in FIG. 4(*c*), the main body portion 5*b* is formed in a T shape in plan view. The pressing portion 5*c* extending to the right and left is provided at the front end of the main body portion 5*b*. The pressing portion 5*c* is a part pressed against the transfer target surface in a state where the transfer tape 3 with a coating film is sandwiched between the pressing portion 5*c* and the transfer target surface.

As will be described later, when the pressing portion 5*c* comes into contact with the transfer target surface, the pressing portion 5*c* becomes parallel to the transfer target surface by the main body portion 5*b* pivoting about the shaft portion 5*a* (hereinafter, referred to as pivoting to the right and left). In this state, the coating film held on the transfer tape 3 is transferred onto the transfer target surface when the pressing portion 5*c* is pressed against a contact target surface and moved on the contact target surface with the transfer tape 3 sandwiched between the pressing portion 5*c* and the contact target surface.

Incidentally, it is preferable that at least the main body portion 5*b* and the pressing portion 5*c* in the transfer head 5 are formed as the inelastic body. By at least the main body portion 5*b* and the pressing portion 5*c* in the transfer head 5 being formed as the inelastic body, the coating film can be more uniformly and satisfactorily transferred onto the transfer target surface.

The inelastic body in the present disclosure refers to an inelastic body in which a deformation angle θ in FIG. 6, which has the attachment end of the main body portion 5*b* as a base point, is 5 degrees or less, and further 3 degrees or less, when a normal transfer load during use is applied with the pressing portion 5*c* of the transfer head 5 abutting against the transfer target surface.

The shaft portion 5*a* is a rod-shaped member extending rearward from the main body portion 5*b* and is attached to the base member 17 so as to be pivotable within a predetermined angle range.

By the shaft portion 5*a* pivoting, the pressing portion 5*c* of the transfer head 5 can be pivoted to the right and left and become parallel to the transfer target surface with ease. Accordingly, there is no need for a user to strongly press the transfer head 5 and elastically deform the pressing portion 5*c* so that the pressing portion 5*c* of the transfer head 5 becomes parallel to the transfer target surface. Therefore, the coating film can be uniformly transferred with a light transfer load.

Incidentally, although the shaft portion 5*a* of the transfer head 5 is attached to the base member 17 in the present embodiment, the present disclosure is not limited thereto and the shaft portion 5*a* may be directly attached to the housing 2.

In addition, a pair of tape guides are disposed on the right and left of the main body portion 5*b* so as to be parallel to each other. The tape guides are the right tape guide 51 and the left tape guide 52.

The right tape guide 51 and the left tape guide 52 are provided with upper side tape guides 51*u* and 52*u* positioned in the upper portion of the main body portion 5*b* and lower side tape guides 51*d* and 52*d* positioned in the lower portion of the main body portion 5*b*, respectively.

An interval dd between the pair of lower side tape guides 51*d* and 52*d* provided on the right and left as illustrated in FIGS. 4(*f*) and 4(*g*) is, for example, −0.03 mm to +0.3 mm with respect to the width of the transfer tape 3.

As illustrated in FIGS. 4(*d*), 4(*e*), and so on, the front ends of the lower side tape guides 51*d* and 52*d* are positioned behind the front ends of the upper side tape guides 51*u* and 52*u* and are at a certain distance from the pressing portion 5*c*.

Then, the front sides of the lower side tape guides 51*d* and 52*d* are obliquely inclined so as to be directed downward and rearward from the front ends and the lower side tape guides 51*d* and 52*d* have a substantially right-angled isosceles triangle shape.

The front ends of the lower side tape guides 51*d* and 52*d* are at a certain distance from the pressing portion 5*c* and the front sides of the lower side tape guides 51*d* and 52*d* are obliquely formed as described above, and thus contact of the pressing portion 5*c* with the transfer target surface is not hindered and the lower side tape guides 51*d* and 52*d* do not hinder transfer.

It is preferable that an interval du between the front ends of the pair of upper side tape guides 51*u* and 52*u* provided on the right and left is wider than the interval dd between the lower side tape guides 51*d* and 52*d*. For example, the interval du is preferably 0.5 mm or more and more preferably 1 mm or more and 3 mm or less with respect to the width of the tape.

The front ends of the upper side tape guides 51*u* and 52*u* are in the vicinity of the pressing portion 5*c* on the side that is in front of the lower side tape guides 51*d* and 52*d*. The front sides of the upper side tape guides 51*u* and 52*u* have a circular arc shape so as to be directed rearward and upward from the front ends and the upper side tape guides 51*u* and 52*u* have a fan shape.

In the present embodiment, the front ends of the upper side tape guides 51*u* and 52*u* are positioned slightly behind the front end of the pressing portion 5*c* (that is, at positions hardly retracted from the pressing portion 5*c*).

Here, the front ends of the upper side tape guides 51*u* and 52*u* indicate the foremost parts among the positions corresponding to a tape path in the upper side tape guides 51*u* and 52*u*.

Incidentally, the interval du between the front ends of the upper side tape guides 51*u* and 52*u* is wider than the interval between the positions with the narrowest interval at the positions of the lower side tape guides 51*d* and 52*d* that correspond to the tape path. In addition, it is preferable that the interval du between the front ends of the upper side tape guides 51*u* and 52*u* is wider than the interval at the position with the widest interval at the positions of the lower side tape guides 51*d* and 52*d* that correspond to the tape path.

The transfer tape 3 is produced by an adhesive or the like being applied by a known method to one surface of a base material in which a release layer such as silicone resin is formed on one or both surfaces of a long body having a thickness of 3 □m to 60 □m and made of paper or a plastic film such as polyethylene terephthalate, polypropylene, and polyethylene.

Used as the adhesive are adhesives such as an acrylic resin-based adhesive, a vinyl resin-based adhesive, a rosin-based adhesive, and a rubber-based adhesive, or the adhesives appropriately blended with an auxiliary such as a cross-linking agent, a tackifier, a plasticizer, an anti-aging agent, a filler, a thickener, a pH adjuster, and an anti-foaming agent. Specifically, an adhesive layer is provided on one surface of the base material in an adhesive tape (tape glue). In a correction tape, an adhesive layer is provided on a concealing layer provided on one surface of the base material and made of a pigment having concealing power, a polymer resin as a binder, and so on. In a fluorescent tape, an adhesive layer is provided on a fluorescent colored layer provided on one surface of the base material. The layer formed on one surface of the base material has a post-drying thickness of, for example, 0.3 □m to 60 □m.

In addition, in general, a transfer tape having a width of approximately 2 mm to 15 mm is used as the transfer tape 3.

As illustrated in FIG. 5, the base member 17 to which the transfer head 5 is attached is a plate-shaped body that is long in the front-rear direction, the lower half portion of the rear end of the base member 17 is obliquely cut in side view, and a reinforcing rib 17*a* is provided at a part of the peripheral edge of the base member 17. A spindle insertion hole 17*b* is formed near the front end of the base member 17.

The base member spindle 18 erected on the inner surface of the left housing member 22 is inserted through the spindle insertion hole 17*b* of the base member 17. As a result, the base member 17 is capable of pivoting within a predetermined range about the base member spindle 18 (hereinafter, referred to as pivoting upward and downward).

A locking tooth insertion hole 17*c* is provided behind the spindle insertion hole 17*b*. An elastic ratchet claw 17*d* locked to locking teeth 19 is provided below the locking tooth insertion hole 17*c*.

Meanwhile, the locking teeth 19 (see FIG. 2) are formed in the winding reel 6.

Then, the locking teeth 19 formed in the winding reel 6 are inserted through the locking tooth insertion hole 17*c*. Then, the reverse rotation of the winding reel 6 is restrained and the transfer tape 3 is prevented from loosening when the transfer tape 3 is not used.

As illustrated in FIGS. 2 and 3, a head receiving portion 17*e* for attaching the shaft portion 5*a* of the transfer head 5 is provided at the front end of the base member 17.

The head receiving portion 17*e* is provided with a receiving portion main body 17*f* molded integrally with the base member 17 and a separate cover material 17*g*.

The receiving portion main body 17*f* is provided with an opening portion 17*h* open on the front and the left side. The cover material 17*g* is mounted onto the receiving portion main body 17*f* after the shaft portion 5*a* of the transfer head 5 is inserted into the opening portion 17*h* from the open left side. As a result, the transfer head 5 is attached to the base member 17.

As illustrated in FIGS. 5(*c*) to 5(*f*), the receiving portion main body 17*f* and the cover material 17*g* are provided with longitudinal grooves 171*f* and 171*g*, respectively. Meanwhile, a projection 5*e* is provided on the shaft portion 5*a* of the transfer head 5. The projection 5*e* is slidably inserted into the longitudinal grooves 171*f* and 171*g* and the transfer head 5 is attached to the head receiving portion 17*e* of the base member 17 so as to be capable of pivoting to the right and left within a predetermined range and so as not to fall.

FIG. 5(*e*) is an end view of a state where the transfer head 5 does not pivot to the right and left and FIG. 5(*f*) is an end view of a state where the transfer head 5 has pivoted to the right and left.

As illustrated in FIG. 5(*f*), when the transfer head 5 pivots to the right and left, the corner of the shaft portion 5*a* abuts against the inner wall surface of the opening portion 17*h* in the head receiving portion 17*e* of the base member 17 and the pivot angle is limited to the right and left of the transfer head 5.

In addition, as illustrated in FIGS. 5(*a*), 5(*b*), and so on, the locking tooth insertion hole 17*c* is formed as a long hole so as not to hinder the upward and downward pivoting of the base member 17.

As illustrated in FIG. 3, a locking claw 17*j* as a rotation restraining portion for restraining the rotation of the supply reel 4 is provided in the left rear portion of the base member 17 that faces the supply reel 4.

Meanwhile, the flange 20 is integrally attached to the supply reel 4. Locked teeth 20*a* (see FIG. 2) are provided on the circumferential edge of the flange 20 and can be locked by the locking claw 17*j*. The flange 20 may be integrally formed when the supply reel 4 is molded. In the present specification, the flange 20 being formed integrally with the supply reel 4 includes a case where the flange 20 is attached to the supply reel 4. In addition, the integral formation also means the supply reel 4 and the flange 20 rotating as a unit.

Figure 7:
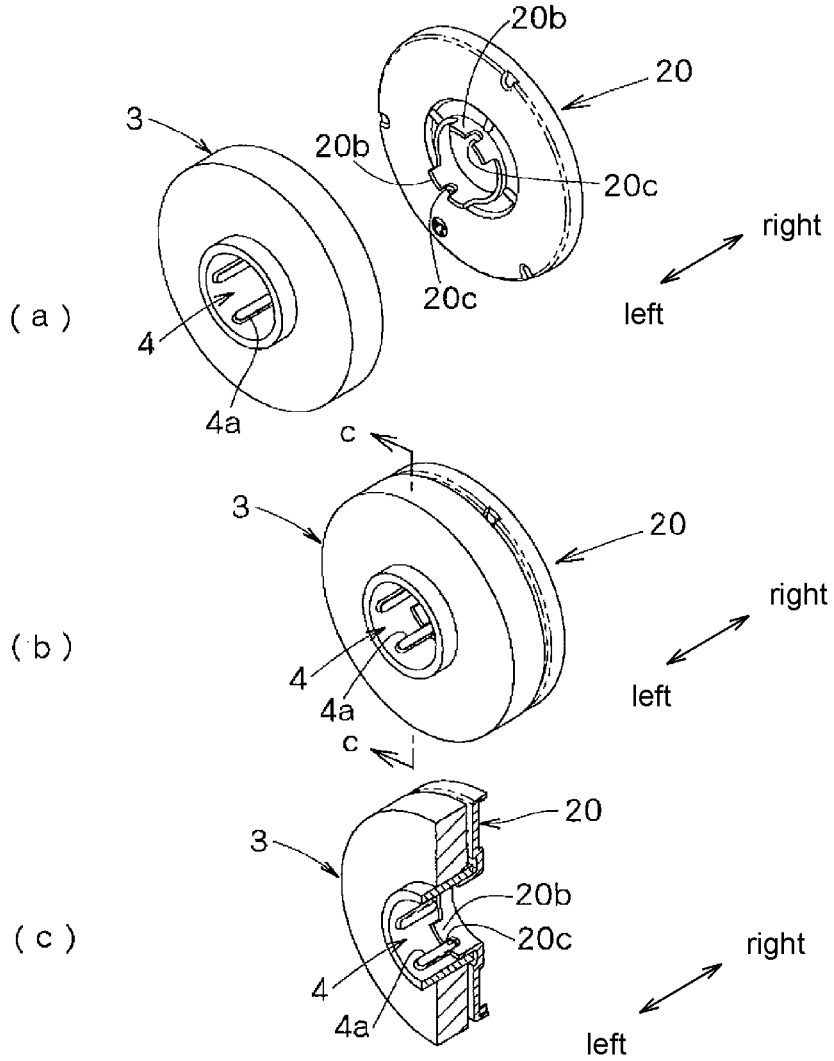
FIG. 7 is a diagram illustrating a form in which a flange is assembled to a supply reel, in which (a) is a pre-assembly upper perspective view, (b) is a post-assembly upper perspective view, and (c) is a longitudinal cross-sectional perspective view taken along the c-c line arrow in (b).

FIG. 7 is a diagram illustrating a form in which the flange 20 is assembled to the supply reel 4, in which (a) is a pre-assembly upper perspective view, (b) is a post-assembly upper perspective view, and (c) is a longitudinal cross-sectional perspective view taken along the c-c line arrow in (b).

An attachment piece 20*b* having a notch 20*c* is provided on the left surface of the flange 20. The rib-shaped locked portion 4*a* of the supply reel 4 is locked into the notch 20*c* of the attachment piece 20*b*. As a result, the supply reel 4 and the flange 20 are assembled so as to rotate as a unit.

Figure 8:
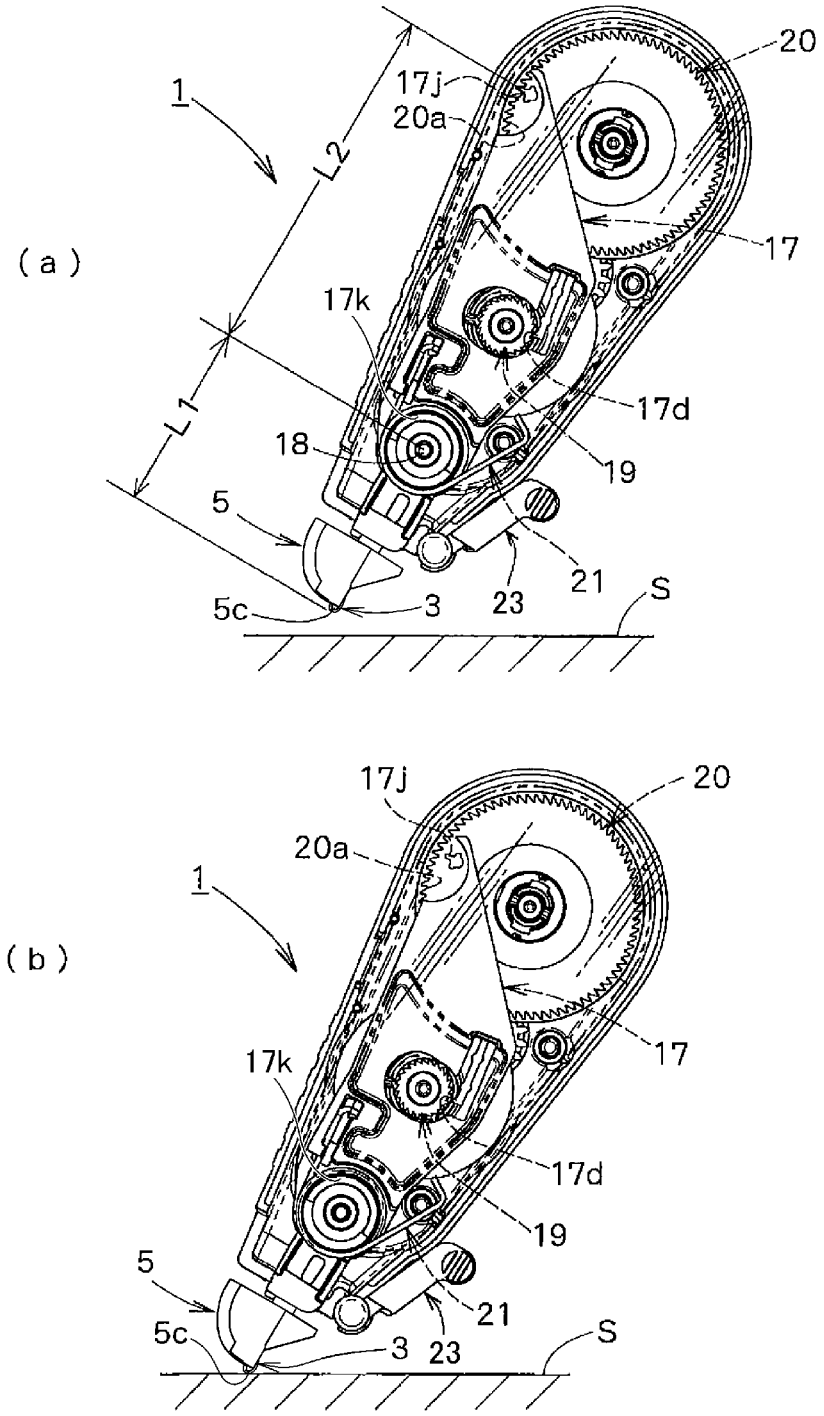
FIG. 8(*a*) is a right side view illustrating a state where the coating film transfer tool is yet to be used and FIG. 8(*b*) is a right side view illustrating a state where the coating film transfer tool is used.

FIG. 8(*a*) is a right side view illustrating a state where the coating film transfer tool 1 is yet to be used and FIG. 8(*b*) is a right side view illustrating a state where the coating film transfer tool 1 is used. Incidentally, in (a) and (b), the locking claw 17*j* is illustrated with the base member 17 cut in part.

A spring boss 17*k* is provided around the spindle insertion hole 17*b* in the base member 17.

A spring member 21 is attached to the spring boss 17*k*. As an elastic return mechanism, the spring member 21 biases the locking claw 17*j* of the base member 17 so as to rotate in the direction of locking to the locked teeth 20*a* of the flange 20.

As illustrated in FIG. 8(*a*), when the coating film transfer tool 1 is not used, the base member 17 is biased upward (counterclockwise as viewed from the right side) about the base member spindle 18 by the elastic force of a spring member 24.

Then, the locking claw 17*j* is locked to the locked teeth 20*a* of the flange 20 and the rotation of the supply reel 4 pivoting integrally with the flange 20 is restrained.

In addition, the elastic ratchet claw 17*d* of the base member 17 is locked with the locking teeth 19 rotating integrally with the winding reel 6 and the reverse rotation of the winding reel 6 for preventing the transfer tape 3 from loosening is also restrained.

When the coating film transfer tool 1 is used, the pressing portion 5*c* of the transfer head 5 is pressed against a transfer target surface S as illustrated in (b).

Then, the base member 17 pivots upward and downward in the direction in which the locked teeth 20*a* of the flange 20 and the locking claw 17*j* are unlocked, the supply reel 4 becomes rotatable, and the transfer tape 3 wound around the supply reel 4 can be drawn.

In addition, by the base member 17 pivoting upward and downward, the elastic ratchet claw 17*d* and the locking teeth 19 are also unlocked, the rotational resistance of the winding reel 6 can be reduced, and it is possible to prevent the generation of a sound that occurs when the elastic ratchet claw 17*d* is in an abutting state.

A head cover 23 is rotatably attached to the lower front portion of the housing 2. The lower part of the transfer head 5 can be covered with the head cover 23 for the coating film of the transfer tape 3 to be protected after the coating film transfer tool 1 is used.

Further, a distance L1 (see FIG. 8(*a*) from the front end of the transfer head 5 attached to the front end of the base member 17 to the base member spindle 18 is set to be shorter than a distance L2 from the base member spindle 18 to the locking claw 17*j*.

As a result, the movable amount of the transfer head 5 for releasing the locking claw 17*j* from locking with the locked teeth 20*a* can be reduced and the coating film transfer tool 1 can be used with a good feeling of use.

In the present embodiment, the transfer head 5 is capable of pivoting to the right and left and the right tape guide 51 and the left tape guide 52 are disposed along the side surface of the main body portion 5*b*. The right tape guide 51 and the left tape guide 52 are provided with the upper side tape guides 51*u* and 52*u* and the lower side tape guides 51*d* and 52*d*, respectively.

Then, the width du between the upper side tape guides 51*u* and 52*u* on the side close to the pressing portion 5*c* is wider than the width dd between the lower side tape guides 51*d* and 52*d* on the side away from the pressing portion 5*c*.

The width dd between the lower side tape guides 51*d* and 52*d* is substantially equal to the width of the transfer tape 3 and is −0.03 mm to +0.3 mm with respect to the width of the transfer tape 3.

According to the present embodiment, when the transfer tape 3 is fed out and passes between the lower side tape guides 51*d* and 52*d* while the coating film transfer tool 1 is used, the rightward and leftward shifting of the transfer tape 3 is restricted by the lower side tape guides 51*d* and 52*d*.

Here, because the interval dd between the lower side tape guides 51*d* and 52*d* is substantially equal to the width of the transfer tape 3, the lower side tape guides 51*d* and 52*d* may come into contact with the transfer tape 3 and the edge portion of the transfer tape 3 may be slightly twisted (bent, deformed, or distorted) in a case where the transfer head 5 has pivoted to the right and left.

However, even when the edge portion of the transfer tape 3 is slightly twisted, the edge portion of the transfer tape 3 is returned to the original state of the edge portion of the transfer tape 3 by the restoring force or the tension of the transfer tape 3 once the transfer tape 3 is further fed out and moves forward from the position of contact with the lower side tape guides 51*d* and 52*d*.

The passage of the transfer tape 3 through the pressing portion 5*c* will be described next. However, first, a case where the width between the upper side tape guides 51*u* and 52*u* is substantially equal to the width of the transfer tape 3 will be described as a comparative form.

In the comparative form, the upper side tape guides 51*u* and 52*u* provided in the vicinity of the pressing portion 5*c* and the edge portion of the transfer tape 3 may come into contact with each other and the transfer tape 3 may be twisted once the transfer head 5 is inclined by pivoting to the right and left when the transfer tape 3 passes through the pressing portion 5*c*.

When the transfer tape 3 is twisted in the vicinity of the pressing portion 5*c* as described above, transfer may be performed with the edge portion of the transfer tape 3 bent during pressing.

Then, this may result in a part that does not come into contact with the transfer target surface S in the coating film, the part may not be transferred onto the transfer target surface S, and the width of the coating film may decrease or a partial defect may arise in the coating film.

However, in the present embodiment, the width between the upper side tape guides 51*u* and 52*u* disposed in the vicinity of the pressing portion 5*c* exceeds the width between the lower side tape guides 51*d* and 52*d*. Accordingly, the possibility that the upper side tape guides 51*u* and 52*u* come into contact with each other is low even when the transfer head 5 is inclined.

Therefore, the possibility that the width of the coating film decreases or the partial defect arises when the transfer tape 3 is transferred onto the transfer target surface is reduced.

In addition, conceivable as another comparative form is increasing the width between the lower side tape guides 51*d* and 52*d* as well as the width between the upper side tape guides 51*u* and 52*u*. However, in this case, the deviation width of the transfer tape 3 in the right-left direction during passing through the lower side tape guides 51*d* and 52*d* can be increased.

Then, the right-left-direction deviation width of the transfer tape 3 in the pressing portion 5*c* further increases. In a case where the coating film transfer tool 1 is left in that state, the next use of the coating film transfer tool 1 is initiated with the transfer tape 3 significantly shifted from the center of the pressing portion 5*c*, which makes the use very difficult.

In contrast, in the present embodiment, the width between the lower side tape guides 51*d* and 52*d* is substantially equal to the width of the transfer tape 3 as described above, and thus the shifting of the transfer tape 3 to the right and left is restricted. Accordingly, the right-left-direction deviation width of the transfer tape 3 in the pressing portion 5*c* does not increase, and thus the next use is facilitated.

In addition, since the transfer tape 3 is not significantly shifted from the center of the pressing portion 5*c*, the transfer head 5 is returned to a specified position (position where the transfer head 5 is not rotated and direction in which the pressing portion 5*c* becomes perpendicular to the direction of movement of the transfer tape 3) by the restoring force or the tension of the transfer tape 3 once the transfer is finished and the pressing force of the transfer head 5 toward the transfer target surface S is released. As a result, convenience is further improved.

Second Embodiment

Figure 9:
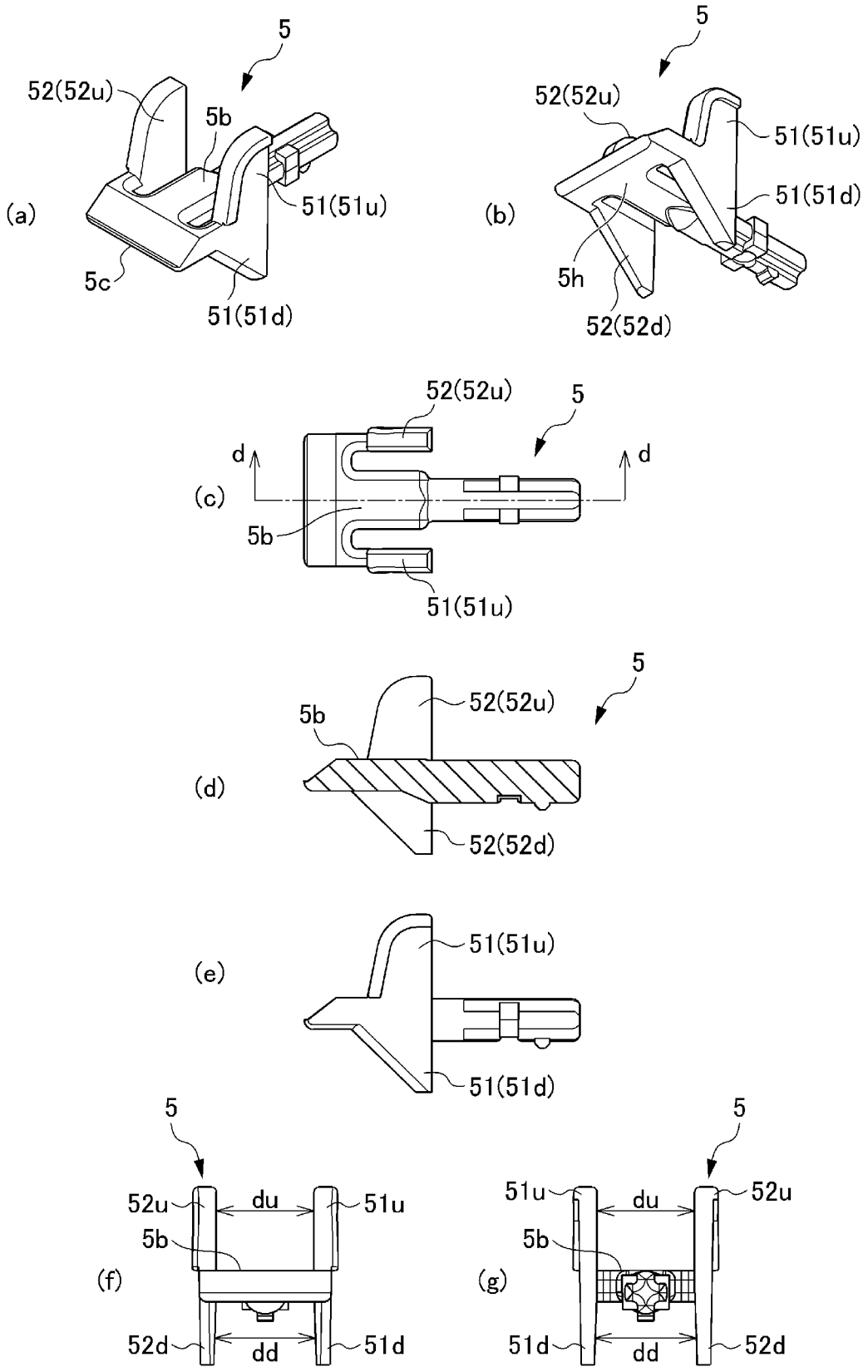
FIG. 9 is an enlarged view of the transfer head according to a second embodiment of the present disclosure corresponding to FIG. 4 of the first embodiment, in which (a) is an upper perspective view, (b) is a lower perspective view, (c) is a plan view, (d) is a longitudinal cross-sectional view taken along the d-d line arrow in (c), (e) is a right side view, (f) is a front view, and (g) is a rear view.

FIG. 9 is an enlarged view of the transfer head 5 according to a second embodiment of the present disclosure. FIG. 9 corresponds to FIG. 4 of the first embodiment. In FIG. 9, (a) is an upper perspective view, (b) is a lower perspective view, (c) is a plan view, (d) is a longitudinal cross-sectional view taken along the d-d line arrow in (c), (e) is a right side view, (f) is a front view, and (g) is a rear view. In the second embodiment, the same parts as those in the first embodiment are denoted by the same reference numerals without being described.

The second embodiment is different from the first embodiment as follows.

As illustrated in FIGS. 9(*d*), 9(*e*), and so on, not only the front ends of the lower side tape guides 51*d* and 52*d* but also the front ends of the upper side tape guides 51*u* and 52*u* are positioned at a predetermined distance behind the pressing portion 5*c*.

Then, the front ends of the upper side tape guides 51*u* and 52*u* are positioned further behind the front ends of the lower side tape guides 51*d* and 52*d*.

In addition, as illustrated in FIGS. 9(*f*) and 9(*g*), the interval du between the upper side tape guides 51*u* and 52*u* is substantially equal to the interval dd between the lower side tape guides 51*d* and 52*d* and is, for example, −0.03 mm to +0.3 mm with respect to the width of the transfer tape 3.

Also in the present embodiment, the right and left of the transfer tape 3 are pressed by the lower side tape guides 51*d* and 52*d* when the transfer head 5 pivots to the right and left, and thus a movement of the transfer tape 3 to the right and left is restricted.

Although the lower side tape guides 51*d* and 52*d* may come into contact with the transfer tape 3 and the edge portion of the transfer tape 3 may be slightly twisted, the deformation of the transfer tape 3 is returned to the original state by the restoring force or the tension of the transfer tape once the transfer tape 3 moves from the position of contact with the lower side tape guides 51*d* and 52*d*.

When the transfer tape 3 passes through the pressing portion 5*c*, there is a possibility that the transfer head 5, that is, the pressing portion 5*c* is inclined by pivoting to the right and left.

However, in the present embodiment, the upper side tape guides 51*u* and 52*u* are positioned away from the pressing portion 5*c*, and thus the edge portion of the transfer tape 3 is unlikely to be twisted due to contact with the upper side tape guides 51*u* and 52*u* in the vicinity of the pressing portion 5*c*.

Accordingly, transfer is unlikely to be performed with the edge portion of the transfer tape 3 bent during pressing.

When the transfer tape 3 is further fed out from the position of the pressing portion 5*c* after the transfer, the transfer tape 3 passes between the upper side tape guides 51*u* and 52*u* having substantially the same width as the transfer tape 3. As a result, the transfer tape 3 is prevented from meandering.

In addition, also in the present embodiment, the transfer head 5 is returned to a specified position (position where the transfer head 5 is not rotated and direction in which the pressing portion 5*c* becomes perpendicular to the direction of movement of the transfer tape 3) by the tension of the transfer tape 3 once the transfer is finished and the pressing force of the transfer head 5 toward the transfer target surface is released.

Although each preferred embodiment of the coating film transfer tool of the present disclosure has been described above, the present disclosure is not limited to the embodiments described above and can be modified as appropriate.

For example, although the transfer head 5 is configured to include the shaft portion 5*a* serving as a pivot shaft of the transfer head 5 and the shaft portion 5*a* is pivotably connected to the base member 17 in the first embodiment and the second embodiment, the present disclosure is not limited thereto. In other words, the shaft portion may be formed so as to protrude forward from the base member and the transfer head may be pivotably connected to the protruding shaft portion.

In addition, in another example, the transfer head may be pivotably connected to the housing by the transfer head being held from the width direction by the housing. In other words, the transfer head may have a configuration (in other words, in which the transfer head can be pivoted with a light force) other than a configuration pivotable by means of the elastic force of the transfer head or a shaft member.

REFERENCE SIGNS LIST

1 Coating film transfer tool
2 Housing
3 Transfer tape
4 Supply reel
5 Transfer head
5*a* Shaft portion
5*b* Main body portion
5*c* Pressing portion
6 Winding reel
7 Supply reel gear
17 Base member (accommodating member)
21 Right housing member
22 Left housing member
23 Head cover
51 Right tape guide
51*d* Lower side tape guide
51*u* Upper side tape guide
52 Left tape guide
52*d* Lower side tape guide
52*u* Upper side tape guide
S Transfer target surface

The invention claimed is:

1. A coating film transfer tool comprising:

a housing having disposed therein a supply reel around which a transfer tape before coating film transfer is wound and a winding reel around which the transfer tape after coating film transfer is wound; and a transfer head pivotable with respect to the housing or an accommodating member accommodated in the housing, and a shaft portion pivotally connecting the transfer head to the housing or the accommodating member, the shaft portion having a long axis oriented in a front-rear direction, such that the transfer head is pivotable about the long axis;

wherein:

the transfer head is provided with a main body portion held by the housing or the accommodating member and protruding from the housing or the accommodating member, a pressing portion provided at a front end of the main body portion, and a pair of tape guides disposed on right and left sides of the main body portion orthogonal to the front-rear direction, the pair of tape guides respectively have lower side tape guides disposed on a side of the main body portion where the transfer tape passes before the coating film transfer and upper side tape guides disposed on a side of the main body portion where the transfer tape passes after the coating film transfer, an interval between front ends of the pair of upper side tape guides is wider than a narrowest interval where the lower side tape guides correspond to a tape path, and the main body portion and the pressing portion form an inelastic body, such that the transfer head is configured to be pivotable about the long axis without utilizing an elastic force.

2. The coating film transfer tool according to claim 1, wherein a front end of the upper side tape guide is disposed closer to the pressing portion than a front end of the lower side tape guide.

3. The coating film transfer tool according to claim 1, wherein the shaft portion is held by the housing or the accommodating member, and the main body portion is provided on a front side as one side of the shaft portion in a longitudinal direction.

4. A coating film transfer tool comprising:

a housing having disposed therein a supply reel around which a transfer tape before coating film transfer is wound and a winding reel around which the transfer tape after coating film transfer is wound; and a transfer head pivotable with respect to the housing or an accommodating member accommodated in the housing, and a shaft portion pivotally connecting the transfer head to the housing or the accommodating member, the shaft portion having a long axis oriented in a front-rear direction, such that the transfer head is pivotable about the long axis;

wherein:

the transfer head is provided with a shaft portion held by the housing or the accommodating member and serving as a center of the pivoting, a main body portion provided on a front side as one side of the shaft portion in a longitudinal direction and protruding from the housing or the accommodating member, a pressing portion provided at a front end of the main body portion, and a pair of tape guides disposed on right and left sides of the main body portion orthogonal to the longitudinal direction, the pair of tape guides respectively have lower side tape guides disposed on a side of the main body portion where the transfer tape passes before the coating film transfer and upper side tape guides disposed on a side of the main body portion where the transfer tape passes after the coating film transfer, a front end of the lower side tape guide is at a position retracted from the pressing portion, the front end of the upper side tape guide is disposed at a greater distance from the pressing portion than the front end of the lower side tape guide, and the main body portion and the pressing portion form an inelastic body, such that the transfer head is configured to be pivotable about the long axis without utilizing an elastic force.

* * * * *